United States Patent [19]

Dadhich

[11] 4,431,372

[45] Feb. 14, 1984

[54] METHOD AND APPARATUS FOR LUBRICATING TURBINE BEARINGS

[75] Inventor: Ghanshyam M. Dadhich, Nether Providence, Pa.

[73] Assignee: Westinghouse Electric Corp., Pittsburgh, Pa.

[21] Appl. No.: 164,858

[22] Filed: Jul. 1, 1980

[51] Int. Cl.[3] ..... F01D 25/20

[52] U.S. Cl. ..... 415/175; 417/84; 184/27 A

[58] Field of Search ..... 60/89.08; 415/175; 184/6.11, 27 A, 27 C; 417/80, 84, 89

[56] References Cited

U.S. PATENT DOCUMENTS

| | | | |
|---|---|---|---|
| 2,571,166 | 10/1951 | Rossetto | 184/6.4 |
| 3,779,345 | 12/1973 | Barnes et al. | 184/6.4 |
| 4,290,736 | 9/1981 | Bernasconi | 417/87 |

FOREIGN PATENT DOCUMENTS

| | | | |
|---|---|---|---|
| 1046697 | 12/1953 | France | 60/39.08 |
| 787701 | 12/1980 | U.S.S.R. | 60/39.08 |

*Primary Examiner*—Louis J. Casaregola
*Attorney, Agent, or Firm*—William D. Lanyi

[57] ABSTRACT

A method and apparatus for supplying lubricant to turbine bearings during normal and abnormal operating modes. A pump coupled to the turbine's rotor discharges lubricant during normal turbine operating modes through an ejector from its inlet port through its outlet port. The lubricant transmitted to the ejector's inlet port is mixed with lubricant withdrawn from a lubricant reservoir during its transmission through the ejector and such mixture is discharged from the ejector's outlet port at a supply pressure. The lubricant mixture is routed to the turbine bearings and the lubricant pump's suction side. When the supply pressure falls below a predetermined value, a clutch is engaged which couples a constant speed drive input linkage to the turbine rotor. The constant speed drive also has an output linkage whose speed is maintained at a constant predetermined value for varying rates of speed on the input linkage. The output linkage is coupled either to an auxiliary lubricant pump or an electrical generator. The auxiliary lubricant pump discharges lubricant into the inlet port of the ejector and takes suction from the outlet port of the ejector. Electricity generated by the electrical generator operates an electrical motor which drives an auxiliary lubricant pump which takes suction from the lubricant reservoir and discharges the lubricant to the turbine bearings.

6 Claims, 2 Drawing Figures

METHOD AND APPARATUS FOR LUBRICATING TURBINE BEARINGS

BACKGROUND OF THE INVENTION

1. Field of the Invention

This invention relates to turbine lubrication systems, and more particularly, to means for ensuring turbine lubrication during turbine operation at any speed.

2. Description of the Prior Art

Typical lubrication systems for turbines used in large central station electrical generation facilities include a centrifugal pump coupled to the turbine's rotor which discharges lubricant into a line directed to a fluid ejector located in or near a lubricant (usually oil) reservoir. During the lubricant's passage through the ejector from its inlet port to its outlet port, a partial vacuum is created through a suction port in the ejector through which lubricant is drawn from the lubricant reservoir and is mixed with the pumped lubricant. The total volume of lubricant (transmitted by the pump and drawn through the suction port) is discharged through the ejector's outlet port and is routed to the turbine bearings and the suction side of the main lubricant pump. A substantial discharge pressure from the main lubricant pump is required (approximately 350 psi) and a sufficient flow volume (typically approximately 1,000 gallons/min. but dependent on the number and size of the bearings) of lubricant is necessary to provide sufficient vacuum through the ejector's suction port to pick up the additional lubricant and transmit the total volume of lubricant at approximately 15 psi. to the turbine bearings and the main lubricant pump's suction side.

Centrifugal pumps (normally used as main lubricant pumps) have dynamic characteristics which provide insufficient lubricant flow rate and discharge pressure below approximately three-fourths design speed of the turbine to withdraw the required additional lubricant from the reservoir and discharge the total volume of lubricant to the bearings and main oil pump's suction side. Thus, for turbine start-ups and shutdowns additional lubrication supply apparatus has, heretofore, been required. Common practice for start-ups and shutdowns has been to provide redundant pumps which withdraw lubricant from the reservoir and discharge that lubricant to the turbine bearings. Such redundant pumps have been driven by AC electrical motors and, in some cases, DC electrical motors which primarily act as backup in case of failure of the AC electric motor or AC electric supply. There have been some cases where both the AC-driven and DC-driven pumps have been out of service or otherwise inoperable at times when they were needed. In cases where the main lubricant pump's flow and pressure were insufficient to provide the required lubricant to the turbine bearings due to inadequate turbine rotor speed and the redundant pumps were out-of-service, the turbine bearings were sometimes adversely affected and sometimes suffered damage from the lack of oil supplied thereto. Such bearing damage required bearing replacement and/or refurbishment at substantial cost and turbine downtime.

Since the turbine bearings must be lubricated for substantially the entire time the turbine rotor rotates, it was desired to provide some system that would supply the necessary lubricant to the turbine bearings until the rotor comes to rest or reaches a speed at which the main centrifugal lubricant pump will provide sufficient lubricant flow and pressure.

SUMMARY OF THE INVENTION

In accordance with the present invention, an improved method and apparatus is provided for supplying lubricant to turbine bearings when the turbine is operating in the normal mode and also in abnormal modes, such as during start-up or shutdown. The turbine lubrication system generally comprises a turbine rotor which is rotatably supported by turbine bearings, a main lubricant pump cooled to the turbine rotor and having suction and discharge sides, a lubricant reservoir, an ejector apparatus having an inlet port fluidly connected to the main pump's discharge side, a suction port fluidly communicating with the lubricant reservoir for withdrawing lubricant therefrom, and a discharge port fluidly communicating with the rotatable support means and the main pump's suction side, a constant speed drive unit having an input linkage whose speed may vary and an output linkage driven thereby whose speed is maintained at a substantially constant rate, a clutch for selectively engaging the rotor and the input linkage when the lubricant pressure discharged from the ejector's discharge port is less than a predetermined value, and means coupled to the output linkage of the constant speed drive means for transmitting lubricant to the rotatable support means. The preferred lubricant transmitting means constitute an auxiliary pump coupled directly to the output linkage and having suction and discharge sides in respective fluid communication with the ejector's discharge port and inlet port. An alternative lubricant transmitting means constitutes an electrical generator coupled to the output linkage, an electrical motor driven by the electrical generator, and an auxiliary pump which is driven by the electrical motor and has a suction and discharge side in respective fluid communication with the reservoir and the rotatable support means.

The method for supplying lubricant to the turbine bearings may generally be practiced by pumping lubricant to an inlet port on an ejector from the discharge side of a pump coupled directly to a turbine rotor, expanding lubricant supplied to the ejector's inlet port through the ejector's discharge port at a supply pressure, withdrawing lubricant from a lubricant reservoir into a suction port on the ejector, transmitting the lubricant entering the ejector to turbine bearings which rotatably support the rotor and to the suction side of the main lubricant pump, coupling an input linkage of a constant speed drive unit to the turbine rotor when the supply pressure falls below a predetermined value, and driving auxiliary means for supplying lubricant to the turbine bearings with an output linkage of the constant speed drive unit. The step of driving auxiliary means for supplying lubricant preferably constitutes pumping lubricant to the ejector's inlet port with an auxiliary pump driven by the output linkage of the constant speed drive unit wherein the auxiliary pump has suction and discharge sides in respective fluid communication with the ejector's discharge and inlet ports. An alternative for driving the auxiliary means for supplying lubricant includes generating electricity with an electrical generator driven by the output linkage, operating an electric motor with the generated electricity, and pumping lubricant to the turbine bearings with an auxiliary pump which takes suction from the lubricant reservoir and is driven by the electrical motor. For the case of the genator being driven by the constant speed drive unit, the ectric motor and auxiliary pump used in combination erewith typically already exist in operating power ants and presently function as backup systems for the ain lubricant pump.

Continued operation of the lubricant transmitting eans is assured during rotation of the turbine rotor by upling them together and sufficient lubricant pressure d flow rate is provided by driving the lubricant transitting means at a constant speed with the constant eed drive unit.

BRIEF DESCRIPTION OF THE DRAWINGS

The invention will be more fully understood from the llowing detailed description of a preferred embodient, taken in connection with the accompanying awings, in which.

DESCRIPTION OF THE PREFERRED EMBODIMENT

Figure 1:
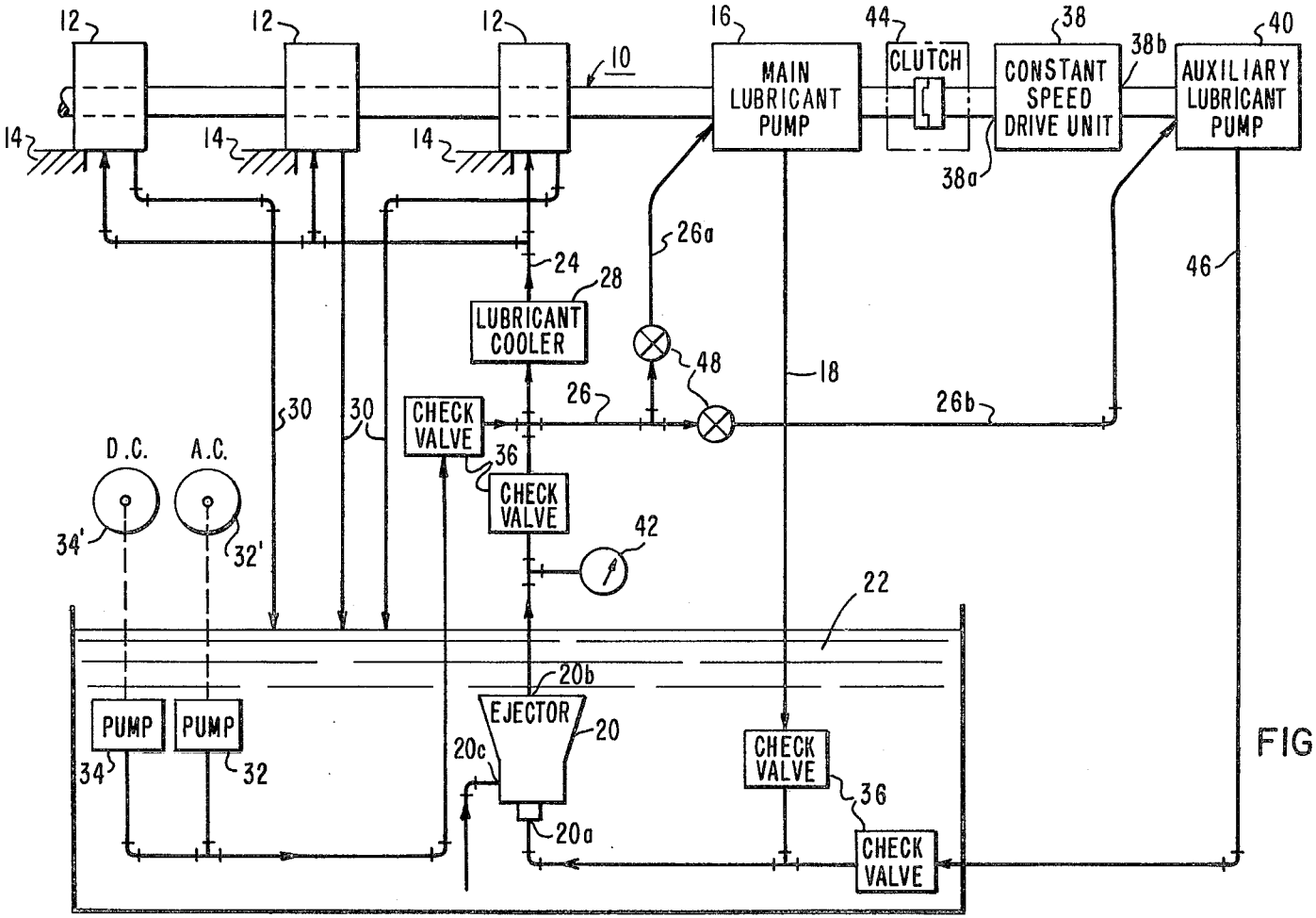
FIG. 1 is a schematic view of the present invention rbine lubrication system.

The present invention is concerned primarily with aring lubrication. Accordingly, in the description hich follows, the invention is shown embodied in a ge power plant turbine system. It should be underood, however, that the invention may be utilized as a brication system for any apparatus capable of driving own lubrication pump.

Turbine rotor 10 is schematically illustrated as being urnaled in bearings 12 which enable turbine rotor 10 be rotatably supported in casing 14. During normal eration of the turbine which shall be defined as eater than approximately three-fourths design speed, ntrifugal main lubrication pump 16 discharges lubrint from its discharge side through line 18 to inlet port *a* of ejector or apparatus 20. Lubricant supplied to let port 20*a* expands through ejector 20 and exits rough discharge port 20*b*. During the expansion pross through ejector 20, additional lubricant is withawn from lubricant reservoir 22 into suction port 20*c* here the withdrawn lubricant mixes with the lubricant pplied to inlet port 20*a* and is discharged through scharge port 20*b* therewith. Lubricant exiting disarge port 20*b* is transmitted through lines 24 and 26 to e bearings 12 and, during normal operation, to the ction side of main lubricant pump 16, respectively. ibricant supply line 24 routes lubricant to bearings 12 rough lubricant cooler 28 so as to improve the lubriting characteristics of the lubricant prior to it being jected into the bearings 12. Lubricant from bearings passes through drain lines 30 into lubricant reservoir .

Lubricant transmission line 26 bifurcates to lubricant ction lines 26*a* and 26*b*. Lubricant suction line 26*a* ovides lubricant flow to the suction side of main lubrint pump 16 which completes the lubricant cycle for rmal operating modes of the turbine.

When the rotating speed of turbine rotor 12 is less an approximately three-fourths the design speed (2400 PM for a 3600 RPM turbine), the discharge pressure m main lubricant pump 16 becomes insufficient (deed as abnormal operation mode) to overcome the essure head required in lifting lubricant from oil reserir 22 to the suction side of lubricant pump 16 and also provide sufficient lubricant through line 24 to bearings 12. Turbine operation below such threshold speed occurs during turbine start-up and shutdown. To prevent bearing wipe and damage resulting therefrom, it has been past practice to initiate operation of an AC motor-driven pump 32 which is disposed in or near oil reservoir 22 for the sake of supplying oil or other lubricant from reservoir 22 to bearings 12. In case AC electric motor-driven pump 32 was incapacitated or otherwise out of service, DC electric motor-driven pump 34 was actuated. The DC pump was typically supplied with electricity by batteries which, in turn, were sometimes discharged or locked out of service. Check valves 36 were disposed on the lubricant transmission line leading from pumps 32 and 34 and on lubricant transmission line 24 to prevent flow of the lubricant in a direction opposite that indicated in FIG. 1.

Constant speed drive unit 38 includes an input and an output linkage 38*a* and 38*b*, respectively. Input linkage 38*a* drives output linkage 38*b* in such a manner that for any speed of input linkage 38*a*, output linkage 38*b* is driven at a constant, desired speed. Auxiliary lubricant pump 40 is driven by output linkage 38*b* of constant speed drive unit 38. When the discharge pressure of lubricant exiting ejector discharge port 20*b* falls below a predetermined minimum (approximately 15 psi) as measured by gauge 42 or other pressure measuring means, clutch 44 or other means for selectively coupling the turbine rotor 10 to input linkage 38*a* is actuated. The turbine rotor preferably extends through and is keyed to pump 16. In the event of such input linkage actuation, lubricant is discharged from the discharge side of lubricant pump 40 through supply line 46 which transmits the lubricant to inlet port 20*a* of ejector 20. The lubricant mixture discharged through discharge port 20*b* of ejector 20 is directed to bearings 12 and into lubricant suction line 26*b* to complete the lubricant's flow cycle during the abnormal mmode of operation of the turbine. To ensure proper flow direction, check valves 36 are also disposed on lubricant lines 18 and 46. Additionally, valves 48 on lubricant suction lines 26*a* and 26*b* are cooperatively adjusted to ensure flow to the proper lubricant pump as appropriate for the mode of operation of the turbine.

Use of constant speed drive unit 38 enables use of centrifugal auxiliary lubricant pump 40 since the constant speed drive 38 will maintain a substantially constant speed on auxiliary lubricant pump 40 for any speed of input linkage 38*a*. Since lubrication for bearings 12 is necessary at all times during rotation of turbine rotor 10, coupling auxiliary lubricant pump 40 to rotor 10 ensures a flow of lubricant during rotation of rotor 10. Furthermore, auxiliary lubricant pump 40 provides redundancy and backup to main lubricant pump 16 and may be repaired or refurbished when clutch 44 is disengaged and turbine rotor 10 is operating. Thus, auxiliary lubricant pump 40, when used in the previously described combination, will provide the required lubricant flow at sufficient pressure to satisfactorily lubricate bearings 12 during the abnormal operating mode of the turbine.

Figure 2:
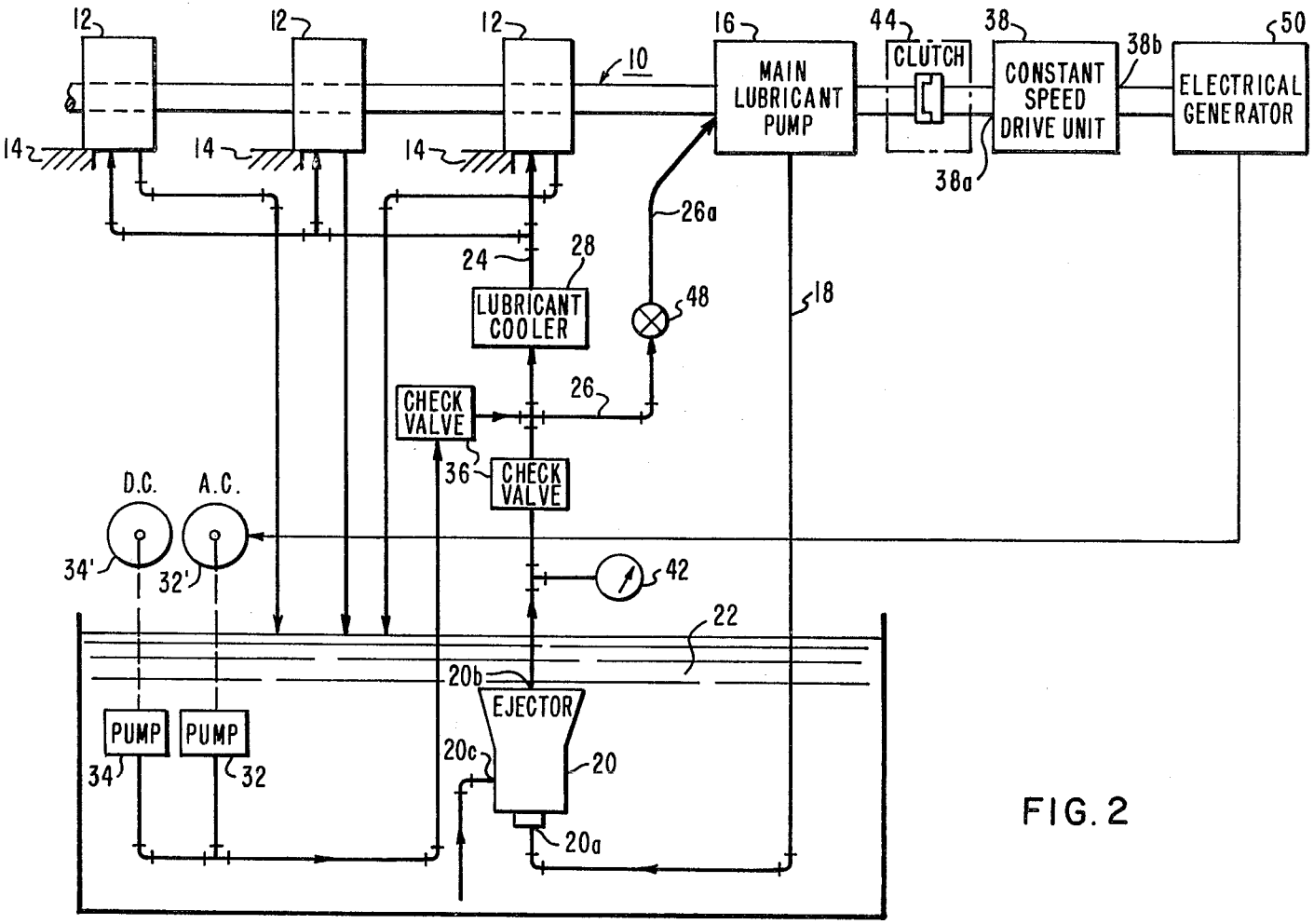
FIG. 2 is an alternate embodiment of the present vention turbine lubrication system.

FIG. 2 is a schematic view of an alternate embodiment of the present invention in which electrical generator 50 is driven by output linkage 38*b* of constant speed drive unit 38. The electricity generated by generator 50 is transmitted to electric motor 32' which drives pump 32. In the embodiment illustrated in FIG. 2, generator 50 will generate a substantially constant current and voltage for varying rates of speed of the turbine rotor.

Since it is driven by constant speed drive unit 38 which is, in turn, driven by turbine rotor 10, a continuous supply of electricity is generated during engagement of clutch 44 and rotation of turbine rotor 10. The clutch 44 of FIG. 2 is again engaged when the supply pressure exiting the discharge port 20*b* of ejector 20 is less than the predetermined minimum value. Electricity generated by generator 50 operates AC motor 32', which drives pump 32 and transmits lubricant from oil reservoir 22 through lubricant supply line 24 to turbine bearings 12.

It will now be apparent that an improved turbine lubrication system has been provided in which an auxiliary lubricant pump is driven by a constant speed drive unit which is selectively linked with the turbine rotor so as to rotate with the turbine rotor once the clutch is engaged. Such constant speed drive unit drives the auxiliary lubricant pump or generator at a constant speed and thus ensures sufficient lubricant pressure and flow rate to the turbine bearings 12 when the main lubricant pump 16 provides insufficient lubricant pressure and flow rate for relatively low turbine rotor speeds.

I claim:

1. A turbine lubrication system comprising:

a turbine apparatus having a rotor, a casing, and means for rotatably supporting said rotor in said casing;

a main lubricant pump coupled to the turbine rotor, said main pump having a discharge side and a suction side;

a lubricant reservoir;

an ejector apparatus having an inlet port in fluid communication with said main pump's discharge side, a suction port in fluid communication with said lubricant reservoir for withdrawing lubricant therefrom, and a discharge port in fluid communication with said rotatable support means and said main pump suction side for discharging the mixture of lubricant drawn from the reservoir and lubricant supplied to the inlet port at a supply pressure;

means having an input linkage and an output linkage driven by said input linkage for providing a substantially constant speed to said output linkage for varying speeds of said input linkage;

means for selectively coupling said rotor and said input linkage when said supply pressure is less than a predetermined value; and means coupled to said output linkage for transmitting lubricant to said rotatable support means.

2. The turbine lubrication system of claim 1, wherein:

said lubricant transmitting means comprises an auxiliary pump coupled to said output linkage having a suction side in fluid communication with said ejector's discharge port and a discharge side in fluid communication with said ejector's inlet port.

3. The turbine lubrication system of claim 1, wherein:

said lubricant transmitting means comprises;

(A) an electrical generator coupled to said output linkage;

(B) an electrical motor driven by said electrical generator; and (C) an auxiliary pump driven by said electrical motor having a suction side in fluid communication with said reservoir and a discharge side in fluid communication with said rotatable support means.

4. A method for supplying lubricant to turbine bearings, said method comprising:

pumping lubricant to an inlet port on an ejector from the discharge side of a main pump coupled to a turbine rotor;

expanding lubricant supplied to the inlet port of said ejector through said ejector and out a discharge port of said ejector at a supply pressure;

withdrawing lubricant from a lubricant reservoir into a suction port on said ejector to form a mixture with the expanding lubricant;

transmitting said mixture to turbine bearings which rotatably support said turbine rotor and to a suction side of said main pump;

coupling an input linkage of a constant speed drive unit to said turbine rotor when the supply pressure falls below a predetermined value; and driving auxiliary means for supplying said lubricant to said turbine bearings with an output linkage of said constant speed drive unit.

5. The method of claim 4, wherein:

said driving step comprises pumping said lubricant to said inlet port of said ejector by an auxiliary pump driven by said output linkage of the constant speed drive unit, said auxiliary pump having suction and discharge sides in respective fluid communication with said discharge and inlet ports of said ejector.

6. The method of claim 4, wherein:

said driving step comprises:

(A) generating electricity with an electrical generator driven by an output linkage of said constant speed drive unit;

(B) operating an electric motor with the generated electricity; and (C) pumping said lubricant to said turbine bearings with an auxiliary pump which takes suction from said lubricant reservoir and is driven by said electrical motor.

* * * * *